US009227743B2

(12) United States Patent
Natterer et al.

(10) Patent No.: US 9,227,743 B2
(45) Date of Patent: Jan. 5, 2016

(54) METHOD FOR PRODUCING A PACKAGE AND PACKAGING MACHINE

(75) Inventors: Johann Natterer, Legau (DE); Helmut Sparakowski, Tannheim (DE)

(73) Assignee: MULTIVAC Sepp Haggenmueller GmbH & Co. KG (DE)

( * ) Notice: Subject to any disclaimer, the term of this patent is extended or adjusted under 35 U.S.C. 154(b) by 1529 days.

(21) Appl. No.: 11/919,766

(22) PCT Filed: Apr. 11, 2007

(86) PCT No.: PCT/EP2007/003230

§ 371 (c)(1),
(2), (4) Date: Nov. 1, 2007

(87) PCT Pub. No.: WO2007/118661

PCT Pub. Date: Oct. 25, 2007

(65) Prior Publication Data

US 2009/0025340 A1 Jan. 29, 2009

(30) Foreign Application Priority Data

Apr. 12, 2006 (DE) ..... 10 2006 017 258

(51) Int. Cl.
*B65B 61/06* (2006.01)
*B65B 9/04* (2006.01)

(52) U.S. Cl.
CPC .. *B65B 9/04* (2013.01); *B65B 61/06* (2013.01)

(58) Field of Classification Search
CPC ..... B65B 61/04; B65B 61/06; B65B 61/065; B65B 7/01; B65B 7/16
USPC ..... 53/471, 450, 433, 453, 478, 484, 486, 53/103, 511, 140, 547, 561
See application file for complete search history.

(56) References Cited

U.S. PATENT DOCUMENTS 3,238,691 A * 3/1966 Miller ..... B65B 41/18 53/396
3,584,430 A * 6/1971 Shearer ..... B65B 61/06 53/449
3,971,188 A * 7/1976 Cawrse ..... B65B 7/2878 53/478
4,349,999 A * 9/1982 Mahaffy ..... B65B 61/18 249/117
4,444,332 A * 4/1984 Widen ..... B65D 43/0212 215/321
4,489,537 A * 12/1984 Gordon et al. ..... 53/511
4,660,735 A * 4/1987 Peschardt ..... B65D 43/0256 215/256
4,819,409 A 4/1989 Mahaffy et al.
5,402,622 A * 4/1995 Stockley, III ..... B65B 9/02 426/129
5,542,234 A * 8/1996 Wyslotsky ..... B65B 31/021 53/433
5,606,847 A * 3/1997 Joensson et al. ..... 53/471
5,737,905 A * 4/1998 Milani ..... 53/512
5,983,607 A * 11/1999 Mihalov ..... B29C 65/18 156/69

(Continued)

FOREIGN PATENT DOCUMENTS

DE 2506446 A1 8/1976
DE 198 17 737 A1 11/1999

(Continued)

*Primary Examiner* — Gloria R Weeks
(74) *Attorney, Agent, or Firm* — Brooks Kushman P.C.

(57) ABSTRACT

A method for producing a package with the following steps is described. Forming of a container (13) in a web of a first web material (7); subsequent sealing of a cover (14) onto the container produced within an outer contour of the package to be produced; and thereafter cutting of the container (13) out of the first web material (7) along the outer contour of the package to be produced and outside of an outer contour of the cover (14) sealed thereon.

10 Claims, 4 Drawing Sheets

(56) References Cited

U.S. PATENT DOCUMENTS

Figure 1:
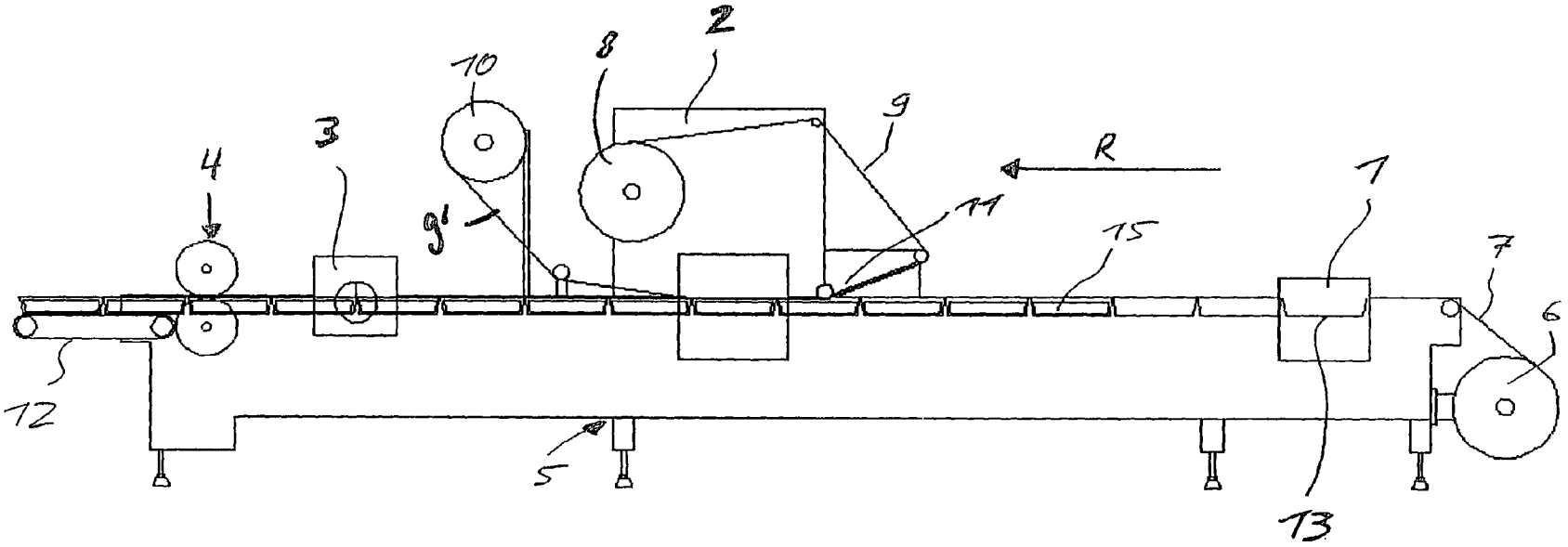

| | | | | |
|---|---|---|---|---|
| 6,070,507 | A * | 6/2000 | Mihalov | B29C 65/18 264/153 |
| 6,161,367 | A | 12/2000 | Walter | |
| 6,170,696 | B1 * | 1/2001 | Tucker et al. | 220/793 |
| 6,662,531 | B1 * | 12/2003 | Schwab | B29C 51/02 53/282 |
| 6,920,737 | B2 * | 7/2005 | Haws et al. | 53/412 |
| 8,287,220 | B2 * | 10/2012 | Oberholzer | B21D 51/443 156/221 |
| 8,794,470 | B2 * | 8/2014 | Wambeke | B65D 43/0256 220/266 |
| 8,875,927 | B2 * | 11/2014 | Pohlman | 220/203.09 |
| 2005/0060964 | A1 | 3/2005 | Meyer et al. | |
| 2007/0295721 | A1 * | 12/2007 | Van Handel | B65D 1/265 220/23.6 |

FOREIGN PATENT DOCUMENTS

| | | | |
|---|---|---|---|
| DE | 10154722 | A1 | 5/2003 |
| DE | 10 2006 020 361 | A1 | 8/2007 |
| EP | 0405365 | A1 | 1/1991 |
| EP | 1 984 250 | B1 | 10/2009 |
| GB | 850089 | | 9/1960 |
| WO | 2007090654 | A1 | 8/2007 |

* cited by examiner

METHOD FOR PRODUCING A PACKAGE AND PACKAGING MACHINE

The present invention relates to method for producing a package and to a packaging machine.

For the purpose of marketing of goods such as food these are often packed in packages which allow a hygienic and optically appealing presentation.

A known kind of packaging is the sealing of goods to be packed in so-called deep drawing packages. These packages are characterized in that the goods can be packed hermetically sealed and, if desired, packed under a modified atmosphere and that in this way the packages can simultaneously be designed cost-effectively and optically appealing. In such a method for producing a package initially lower parts of the package are formed from a web of a film material, in most cases a plastic film, in the film material by means of deep drawing. These lower parts of the package are filled thereafter with the good to be packed and thereafter a film material is sealed along a circumferential edge as a cover onto the respective lower parts of the package. In a subsequent separation process which takes place in a single or in several consecutive steps, the produced packages are separated in such a way that the material of the lower parts of the packages and the cover are simultaneously separated along the outer contour of the package to be produced. In DE 25 06 446 A1 a deep drawing machine is disclosed in which the separation takes place in two steps, in the direction of transport and perpendicular to the direction of transport.

According to such a method packages can be produced in a cost-effective manner. The packages produced, however, have the disadvantage that their edge is formed by a horizontally extending shallow edge portion which is partly sharp-edged and for certain applications does not satisfy the requirements of the optical design of the package. If it is desired that the edge of the lower part of the package has an angled or bent-down shape, the package cannot reasonably be produced with this method, since the cutting of the materials of the lower part of the package and of the cover has to take place in two planes having a distance from each other.

In another known method initially pre-manufactured containers are provided and filled. Afterwards a cover film is sealed onto the filled containers which is cut into shape after sealing. The last mentioned methods have the advantage that packages can be produced which are designed with an angled or bent-down edge area of the container, which results into an improved optics of the package. It is, however, a disadvantage of these methods that the pre-fabricated containers have to be individually exactly positioned before the filling and sealing in order to allow a reliable filling and sealing. Often the containers are produced at a location different from the location of filling, are connected to greater combinations in stacks and transported to the location of filling. In these cases the containers have to be additionally unstacked prior to filling. This method is therefore more elaborate than the first described method.

In DE 101 54 722 A1 a packaging machine is disclosed wherein initially package cavities are formed from a film and these are separated out of the film with a cutting station arranged behind. Afterwards, after the filling, a cover film is sealed onto the separated package cavities and the cover film is finally cut into the desired shape. Since the cover film is sealed onto the separately provided, independent package cavities, the same have to be exactly positioned before the sealing. If in one step a cover film has to be sealed onto several package cavities, the package cavities have to be grouped in advance.

It is the object of the present invention to provide an improved method for producing a package and an improved packaging machine which allow to generate packages which fulfil highest requirements as far as the optics is concerned and which also can be produced in a cost-effective manner.

The object is solved by a method according to claim 1 and by a packaging machine according to claim 12. Further developments of the invention are characterized in the dependent claims.

With the method according to the invention and the packaging machine according to the invention packages can be produced which have a shape which is designed in an optically appealing manner. In particular, the edges of the package can be formed with angled or bent-down edges. In addition, an advantage consists in that compared to devices and methods in which covers are sealed onto pre-fabricated package cavities or containers, an exact positioning and grouping of the container has not to take place, since the position of the containers is controlled along the whole working distance. By means of this the packages can be produced in a cost-effective manner and in a small space.

The separation of the packages takes place only at the end of the packaging process and a reliable transport during the packaging process is guaranteed. During the separation of the packages the material of the cover sealing the package is not cut and sharp-edged packaging edges can be avoided. The separation of the packages out of the web material can take place exactly and curtly along a predetermined individually shaped outer contour, whereby optically appealing and mechanically stable packages can be produced.

Figure 2:
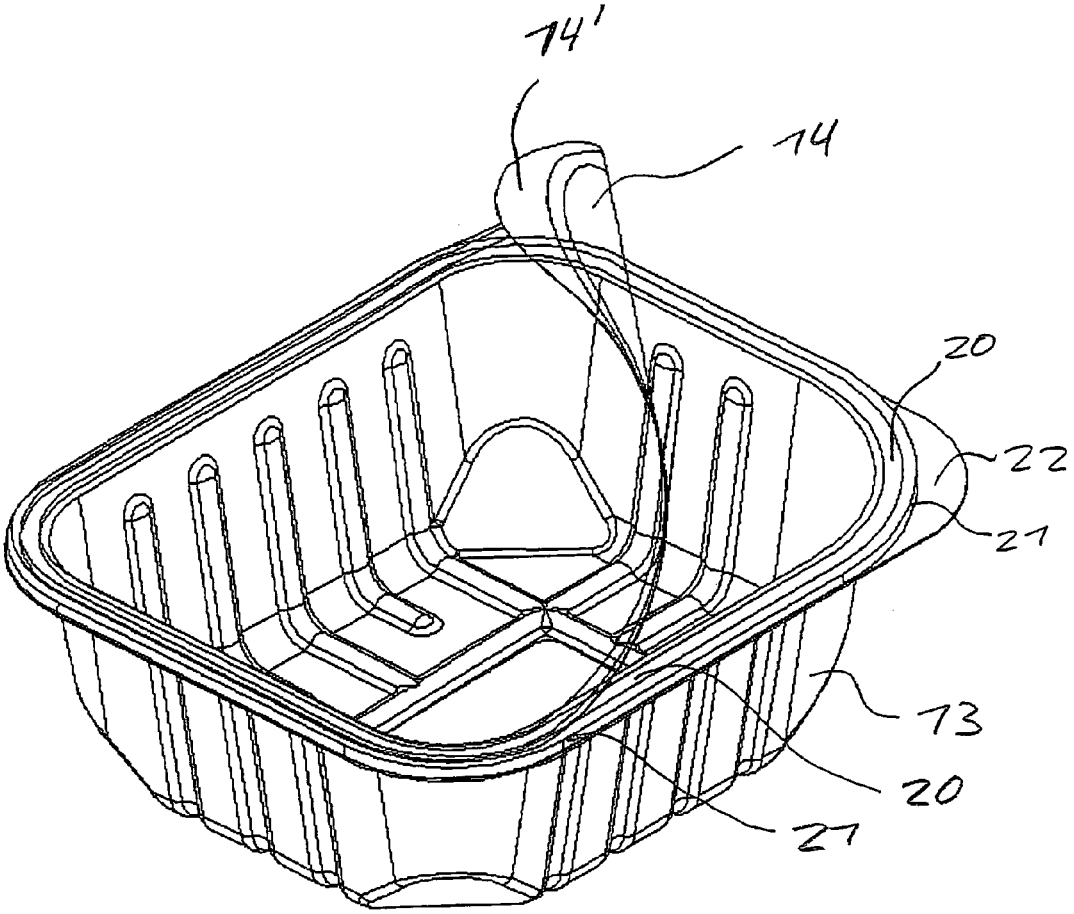
Figure 3:
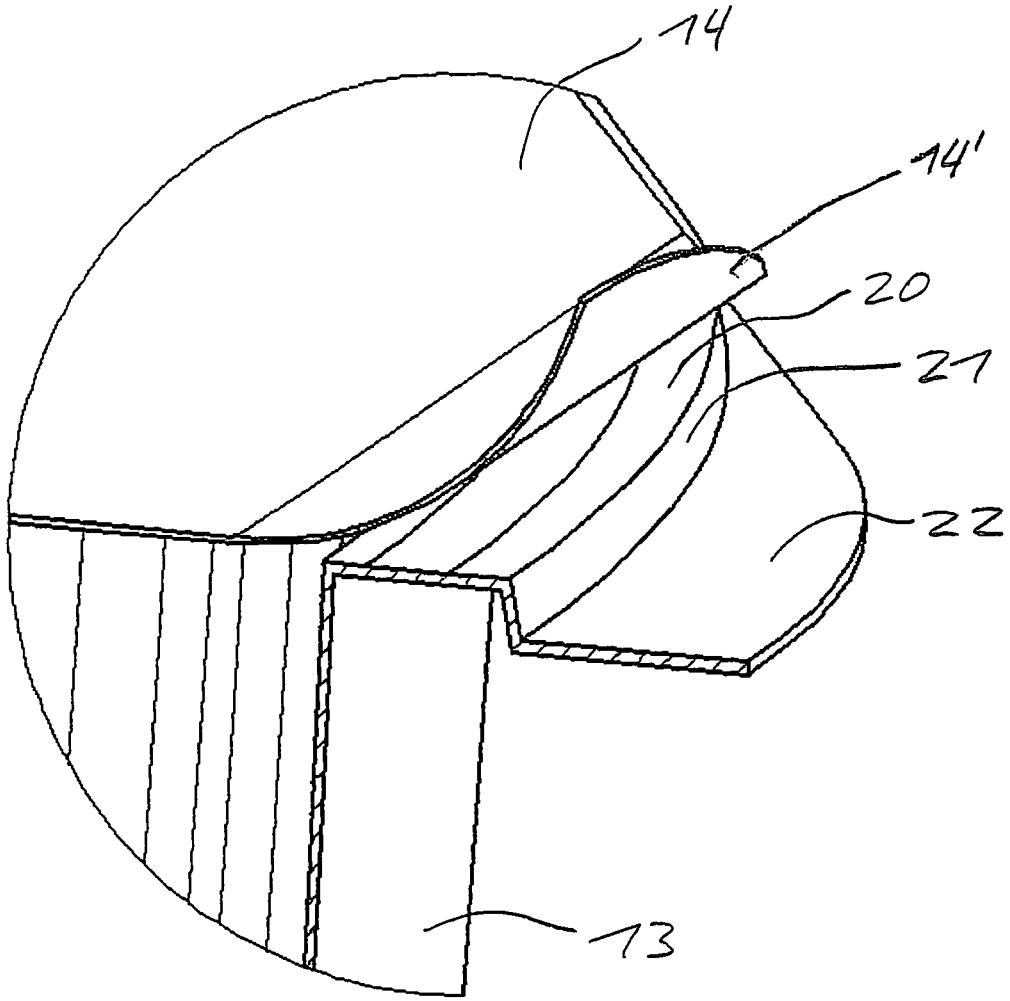
Figure 4:
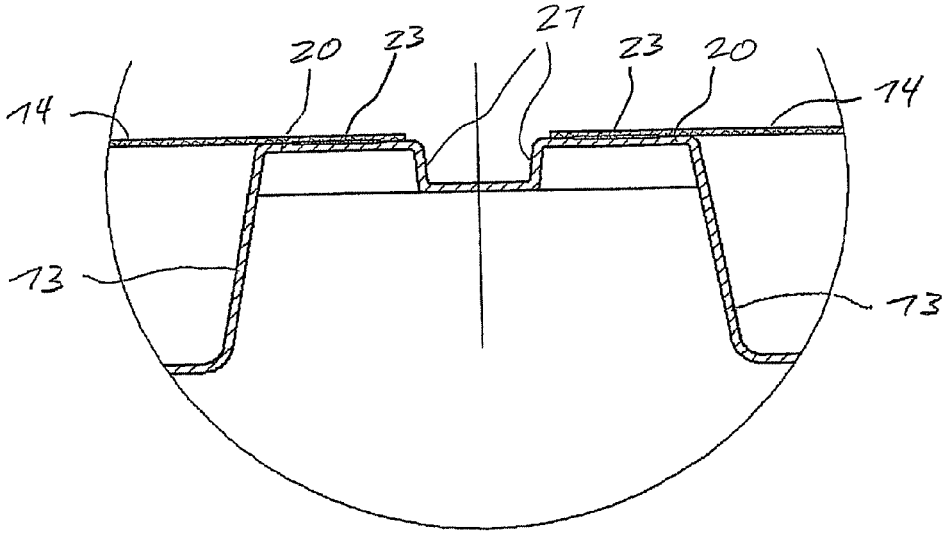
Figure 5:
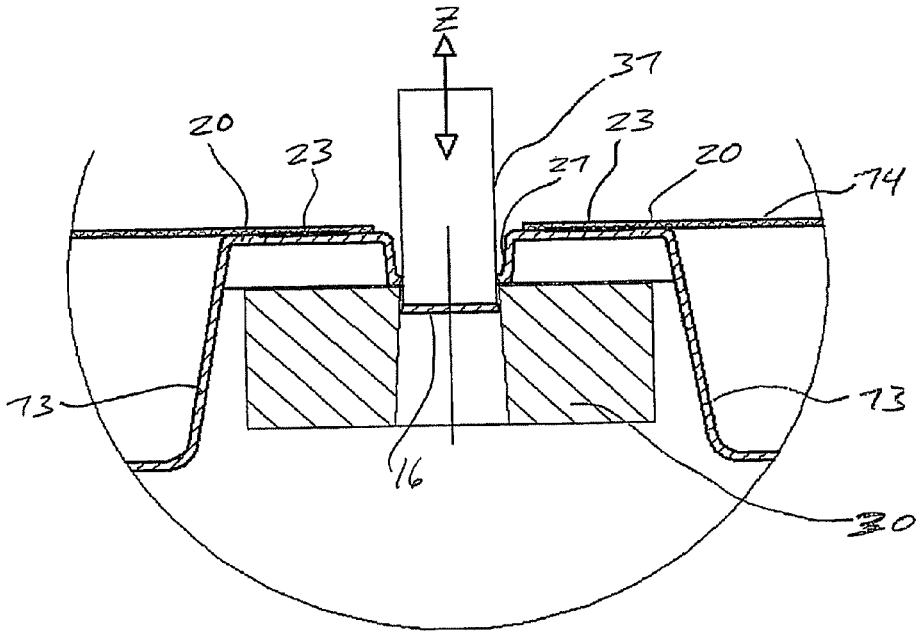

Further features and advantages of the invention result from the description of embodiments with the accompanying drawings. In the drawings show:

FIG. 1 a schematic representation of a packaging machine;

FIG. 2 a schematic perspective representation of a package generated with the method according to the invention;

FIG. 3 a schematic sectioned detailed view of an edge of the package shown in FIG. 2;

FIG. 4 a schematic cross sectional representation of the edge area of two neighbouring packages; and FIG. 5 a schematic representation of the cutting station for separating the packages.

In the following an embodiment of the present invention is described with reference to the accompanying drawings.

As can be seen in FIG. 1, the packaging machine comprises a forming station 1, a sealing station 2, a transverse cutting device 3 and a longitudinal cutting device 4 which are arranged in this order in the working direction R at a machine frame. At the input side a supply roll 6 is located at the machine frame R, from which a first web material 7 is unrolled. In the area of the sealing station 2 a second supply roll 8 is provided, from which a second web material 9 is unrolled. Behind the sealing station 2 a discharge device 10 in form of a roll is arranged on which a reminder film grid 9' of the second web material remaining behind the sealing station 2 is rolled up.

In the region of the sealing station 2, further, a transport device 11 is provided by means of which the second web material 9 is actively transported in a main working cycle into the sealing station 2 and out of the same. This transport device 11 can be realized, for example, by means of chains arranged laterally or by means of gripping devices or friction rolls. At the output side a discharge device 12 in form of a transport conveyor is provided at the packaging machine, with which finished separated packages are transported away. Furthermore, the packaging machine comprises a feeding device which is not shown, which grips the first web material laterally and transports it in the main working cycle incrementally in the working direction. The feeding device can be realized, for example, by laterally arranged transport chains, lateral gripping devices or friction rolls.

In the embodiment shown the forming station 1 is realized as a deep drawing station in which containers 13 are formed in the first web material 7 by means of deep drawing. Thereby, the forming station 1 can be designed in such a way that in the direction perpendicular to the working direction R several containers are formed in parallel. In the transport direction R behind the forming station 1 a filling station which is not shown is provided in which the containers 13 formed in the first web material 7 are filled.

In the embodiment shown the sealing station 2 is defined as a combined sealing and cover cutting station. This combined sealing and cover cutting station is defined in such a way that covers 14 are cut out of the second web material 9 and are sealed onto a circumferential upper edge of the containers 13. Thereby, the covers 14 are cut out of the second web material 9 with a punch and are sealed between a sealing upper part and a sealing lower part with the material of the container 13 by means of heat supply. The first and the second web material 7, 9 are in this embodiment formed by plastic films, respectively. The sealing station is furthermore designed in a known manner as a closed chamber in which the atmosphere in the containers 13 is substituted prior to sealing by an exchange gas, such as, for example, $CO_2$ as a protective gas.

The transverse cutting device 3 is designed as a punch separating the first web material 7 in a direction transverse to the working direction between neighbouring containers 13. Thereby, the transverse cutting device 3 is working in such a manner that the first web material is not cut over the whole width of the web but is not separated in at least an edge area. This allows a controlled further transport by the feeding device.

The longitudinal cutting device 4 is in the embodiment shown designed as a blade arrangement with which the first web material 7 is cut through between neighbouring containers 13 and at the lateral edge of the first web material 7 in such a way, that behind the longitudinal cutting device 4 separated packages are provided which are separated out of the first web material 7.

The operation of the above described packaging machine is described in the following.

The first web material 7 is unrolled from the supply roll 6 and transported by the feeding device into the forming station 1. In the forming station 1 containers 13 are formed in the first web material 7 by means of deep drawing. The containers are formed thereby in such a manner that they comprise in their circumferential edge area a horizontal first edge portion 20 to which outside an angled or bent-down second edge portion 21 joins in a circumferential direction which extends substantially vertically, as shown in FIG. 2 to 4. In this way an edge of the container 13 is formed in the form shown with a horizontal portion 22 joining at the outside to the second edge portion 21.

The containers 13 formed are further transported together with the surrounding material of the first web material 7 in a main working cycle to the filling station in which they are filled with the goods 15 to be packed.

Subsequently the filled containers 13 are further transported together with the material of the first web material 7 surrounding them in the main working cycle by the feeding device into the sealing station 2. Synchronized with the feeding of the filled containers 13 the second web material 9 is transported by the transport device 11 in the main working cycle actively into the sealing station 2. In the sealing station 2 which is designed as a combined sealing and cover cutting device covers 14 are cut out of the second web material 9 and are sealed onto the containers 13. This operation is described more in detail by means of FIG. 2 to 4.

The covers 14 are cut out of the second web material 9 in such a way that their outer contour extends inside the outer contour of the container 13 defined by the second edge portion 21 and the horizontal portion 22. The covers 14 are further sealed inside the outer contour of the container 13 along a sealing seam 23 onto the first edge portion 20. In FIG. 4 a section through two neighbouring containers onto which already covers 14 have been sealed is shown schematically in detail. As can be gathered from FIG. 4 the sealing seam 23 respectively extends within the outer contour of the container 13 defined by the angled or bent-down edge and the material of the covers 14 extends only so far that it ends before the outer contour of the container 13. In other words, the material of the cover 14 behind the sealing station 2 does not project out of the outer contour of the container 13 defining the later edge of the package. As shown in FIGS. 2 and 3 a rounded edge 14' of the cover 14 which is located at the edge of the container 13 which is provided with the horizontal section 22 projects from the first edge portion 20 over the horizontal section 22 after the sealing and allows thereby a comfortable handling during opening of the package.

As can also be gathered from FIG. 4, the first web material 7 extends behind the sealing station 2 still between neighbouring containers 13, 13 in such a way that they are connected with each other. This ensures that the filled and sealed containers 13 can be further transported also after the sealing station 2 in the main working cycle of packaging machine together with the first web material 7.

A remaining grid 9' of the second web material 9 remaining after the cutting out of the covers 14 is on the outside of the sealing station 2 wound up onto a discharge roll 10 so that it can be discharged or supplied to a recycling.

After the sealing station 2 the sealed containers 13 are further transported with the feeding of the first web material 7 into the transverse cutting device 3 in which the first web material 7 is cut through between the containers in the direction perpendicular to the working direction R. The functioning of the transverse cutting device 3 is described with reference to FIG. 5.

As can be seen in FIG. 5, the transverse cutting device 3 consists of a cutting tool 31 and a counter bearing 30. The cutting tool 31 can be moved in a vertical direction Z with reference to the counter bearing 30 in such a way that in case a first web material 7 is located in between, a strap 16 of first web material 7 is cut out between two containers 13. The transverse cutting device 3 is thereby defined in such a way that the cut takes place as curtly as possible at the outer contour of the container 13 formed by the angled or bent-down second edge portion 21. In this way it is important that when performing the cut the material of the cover 14 is not cut through, since it already ends within the outer contour of the container 13.

The transverse cutting device 3 is thereby formed in such a manner that the first web material 7 is cut through between the containers in the direction transverse to the working direction, however, at least an area at the lateral edges of the first web material 7 is not cut through to allow a reliable further transport. Depending on the design of the forming station 1 and the sealing station 2 in the first web material 7 a plurality of containers 13 are arranged and sealed side by side and one after another, respectively. In the transverse cutting device 3 together with the cutting through of the first web material 7 in the transverse direction the rounded edges of the containers 13 shown in FIG. 2 are also formed simultaneously.

After the transverse cut has been carried out and the rounded edges have been formed the containers 13 which are not yet cut in the longitudinal direction are further transported with the first web material 7 to the longitudinal cutting device 4. Since the first web material 7 is not completely cut through in transverse direction in the transverse cutting device 3 but at least a continuous edge portion is left, a reliable further transport of the containers 13 which are still connected to the first web material 7 can take place.

In the longitudinal cutting device 4 the first web material 7 is cut in the working direction, that means in the longitudinal direction, along the outer contour of the container 13 between the rounded edges. Thereby, the cut is again performed as curtly as possible along the angled or bent-down second edge portion 21 forming the outer contour of the container 13. Again it is important that the material of the cover 14 is not cut through, since it ends within the outer contour of the container 13.

By means of the cutting performed in the longitudinal cutting device 4 the produced sealed containers 13 are completely separated out of the first web material 7 and are transported away by the discharge device 12 as individual finished packages.

With the packaging machine described and the method described the packages shown in FIGS. 2 and 3 can be produced. As can be seen in FIG. 2, the produced package has an optically appealing downwardly angled or rounded edge 21 which has in the embodiment shown a U-shaped cross section. If so desired, for example, an edge of the package as shown in FIG. 2 can be provided with a horizontal edge portion 22 from which the cover 14 with a projecting edge 14' is detached from the container 13 for opening of the package.

With the packaging machine described it is possible to produce optically appealing packages with angled or bent-down edges on a deep drawing machine in which not only the receiving containers but also the covers can be produced and sealed together within a short working distance. Furthermore, during the whole process the control over the containers is not given up, since they were carried along with the first web material until the last method step. Hence, packages with given shapes can be efficiently produced on a cost effective deep drawing machine, which could be produced hitherto only with complex and more expensive methods.

The active transport of the second web material 9 by means of the transport device 11 has the advantage that the feeding of the second web material over the containers 13 can take place exactly and that the remaining remainder grid can be reliably transported away from the sealing device. The transport device 11, for example, can be arranged ahead the sealing station, behind the sealing station or in such a manner that it extends through the sealing station.

Modifications of the embodiments described are possible. For example, the transverse cutting device and the longitudinal cutting device can be combined to a single cutting station in which the containers can be cut out of the first web material 7, for example with a punch, circumferentially along their outer contour. It is however important, that the material of the covers 14 has not to be cut through during the cutting and that angled or bent-down edges of the packages are generated.

In a further modification also pre-fabricated covers can be sealed onto the containers 13 formed in the first web material 7. These should not extend over the outer contour of the packages to be produced and should not be cut through during the separation of the packages in order to be able to produce appealing packages with angled or bent-down edges.

In one operation a plurality of packages can be worked side by side and one after another in the working direction R.

The invention claimed is:

1. A method for producing a package comprising:

forming a container in a web of a first web material;

subsequent sealing of a cover onto the container produced so that the cover is provided within an outer contour of the package to be produced; and subsequent separation of the container out of the first web material along the outer contour of the package to be produced and outside an outer contour of the cover sealed thereon;

wherein the method is carried out such that the cover is sealed to the container along a sealing seam, and such that the container has a downwardly extending edge portion disposed outside the sealing seam after separation of the container out of the first web material, and wherein the cover is cut out of a web of a second web material before the sealing, wherein the forming and separation of the container take place in such a manner that the container includes a horizontal edge portion that extends outwardly beyond the downwardly extending edge portion, and wherein the cover includes a projecting edge that extends over the horizontal edge portion.

2. The method according to claim 1, wherein forming the container comprises deep drawing the first web material.

3. The method according to claim 1, wherein during the separation of the container out of the first web material, the cover is not cut through.

4. The method according to claim 1, wherein the edge portion extends substantially vertically.

5. The method according to claim 1, wherein the cover is cut to size prior to the sealing.

6. The method according to claim 1, wherein cutting of the cover out of the second web material and the sealing of the cover take place in one working station.

7. The method according to claim 1, wherein the forming and separation of the container take place in such a way that the produced package has a substantially U-shaped edge, and wherein the downwardly extending edge portion defines part of the U-shaped edge.

8. The method according to claim 1, wherein after the forming of the container and before the sealing of the cover a filling of the container takes place.

9. A method for producing packages, the method comprising:

forming containers in a first web material such that each container has a downwardly extending circumferential edge portion;

sealing covers onto the containers so that an outer contour of each cover ends before an outer contour of a corresponding package to be produced; and separating each container out of the first web material along the outer contour of the corresponding package to be produced and outside the outer contour of the corresponding cover sealed thereon;

wherein the method is carried out such that each cover is not connected to covers sealed onto neighboring containers after the sealing step and before the separating step, and wherein the method is further carried out such that each container includes a horizontal edge portion that extends outwardly beyond the downwardly extending edge portion, and each cover includes a projecting edge that extends over the horizontal edge portion of a respective container.

10. The method of claim 9 wherein each cover is sealed to a respective container along a sealing seam, and the downwardly extending circumferential edge portion of the respective container defines an outer surface disposed outside the sealing seam after separating the respective container out of the first web material.

* * * * *